US009171666B2

(12) United States Patent
Atsumi

(10) Patent No.: US 9,171,666 B2
(45) Date of Patent: Oct. 27, 2015

(54) REACTOR

(71) Applicant: Takashi Atsumi, Okazaki (JP)

(72) Inventor: Takashi Atsumi, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/035,358

(22) Filed: Sep. 24, 2013

(65) Prior Publication Data

US 2014/0085041 A1 Mar. 27, 2014

(30) Foreign Application Priority Data

Sep. 24, 2012 (JP) ..... 2012-209269

(51) Int. Cl.

| | |
|---|---|
| ***H01F 38/12*** | (2006.01) |
| ***H01F 27/36*** | (2006.01) |
| ***H01F 5/00*** | (2006.01) |
| ***H01F 27/40*** | (2006.01) |
| ***H01F 37/00*** | (2006.01) |

(52) U.S. Cl.

CPC ..... *H01F 27/365* (2013.01); *H01F 5/00* (2013.01); *H01F 27/402* (2013.01); *H01F 37/00* (2013.01); *H01F 38/12* (2013.01)

(58) Field of Classification Search

CPC ..... H01F 5/00; H01F 27/00–27/32
USPC ..... 336/65, 83, 90, 96, 200, 232–233, 84 M
See application file for complete search history.

(56) References Cited

FOREIGN PATENT DOCUMENTS

| | | |
|---|---|---|
| JP | A-2009-267360 | 11/2009 |
| JP | A-2010-272771 | 12/2010 |
| JP | A-2010-272772 | 12/2010 |
| JP | A-2011-199080 | 10/2011 |
| WO | WO 2011158632 A1 * | 12/2011 |

* cited by examiner

*Primary Examiner* — Tuyen Nguyen
(74) *Attorney, Agent, or Firm* — Oliff PLC

(57) ABSTRACT

A reactor includes a coil, a magnetosensitive element attached to a lead wire of the coil, a magnetic shielding plate that shields the magnetosensitive element from a magnetic field of the coil, and a case body in which the magnetic shielding plate, the magnetosensitive element and the coil are housed. In the reactor, the magnetosensitive element and the coil are covered with a resin containing a magnetic material in the case.

4 Claims, 5 Drawing Sheets

REACTOR

INCORPORATION BY REFERENCE

The disclosure of Japanese Patent Application No. 2012-209269 filed on Sep. 24, 2012 including the specification, drawings and abstract is incorporated herein by reference in its entirety.

BACKGROUND OF THE INVENTION

1. Field of the Invention

The present invention relates to a reactor. A reactor is a passive element that uses a coil, and is also referred to as "inductor."

2. Description of Related Art

A reactor is used in a circuit, such as a voltage converter, in motor drive systems of electric vehicles including hybrid vehicles. Also, the current that flows through a reactor is measured to control the current precisely in some motor drive systems. For example, Japanese Patent Application Publication No. 2010-272771 (JP 2010-272771 A) and Japanese Patent Application Publication No. 2010-272772 (JP 2010-272772 A) disclose a technique for use in combining a reactor and a current sensor. In either document, a current sensor is attached to a lead wire of a coil that is wound around a core of a magnetic material and the current sensor is embedded, together with the core, in a part of a resin that covers the coil.

A typical current sensor is constituted of a ring-shaped core of a magnetic material that surrounds a conductor as a current measurement object, and a magnetosensitive element disposed in a part of the ring of the core. The above reactors all require the core of the coil and the core of the current sensor to be produced separately and assembled later.

SUMMARY OF THE INVENTION

One aspect of the present invention provides a reactor with a current sensor which is highly manufacturable because there is no need to produce the core of the coil and the core of the current sensor separately. A reactor according to one aspect of the present invention includes a coil that is formed by winding a wire, a magnetosensitive element attached to a lead wire of the coil, and a case in which the magnetosensitive element and the coil are housed. The case has a magnetic shielding plate through which the lead wire extends and which shields the magnetosensitive element from a magnetic field of the coil. The magnetosensitive element and the coil are covered with a resin containing a magnetic material in the case.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
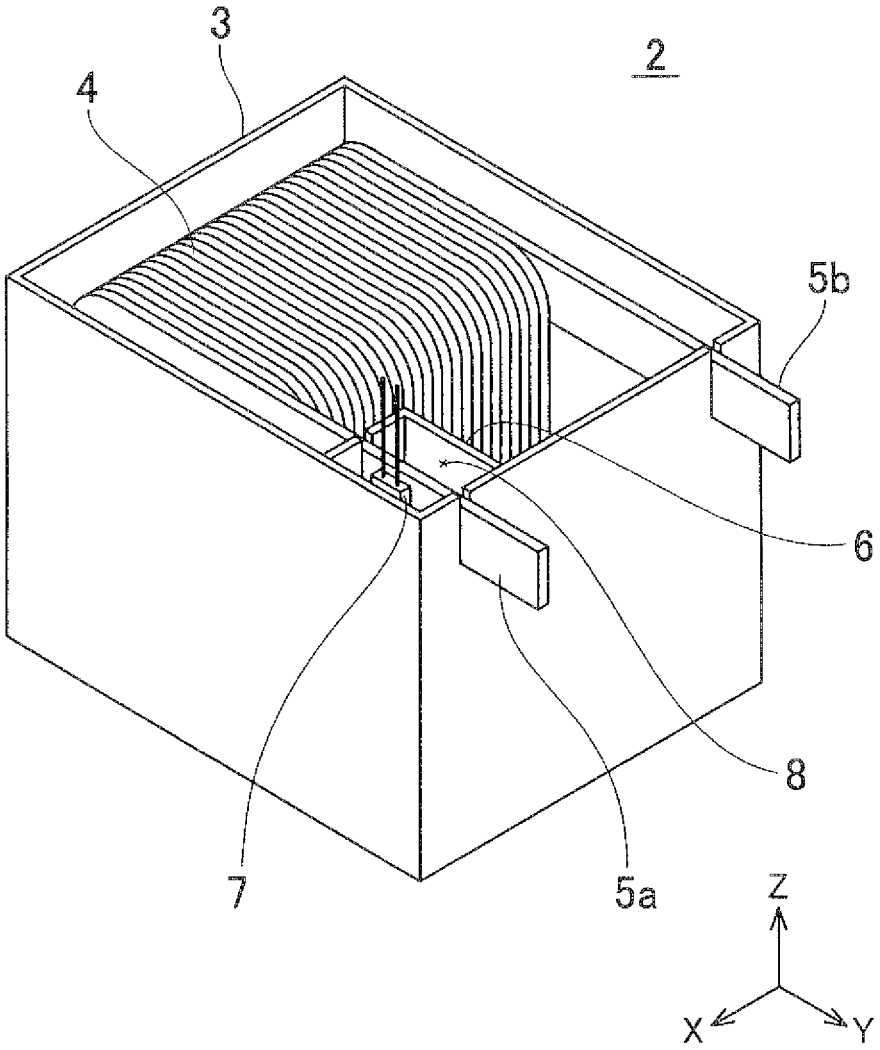
FIG. 1 is a perspective view of a reactor according to an embodiment.
Figure 2:
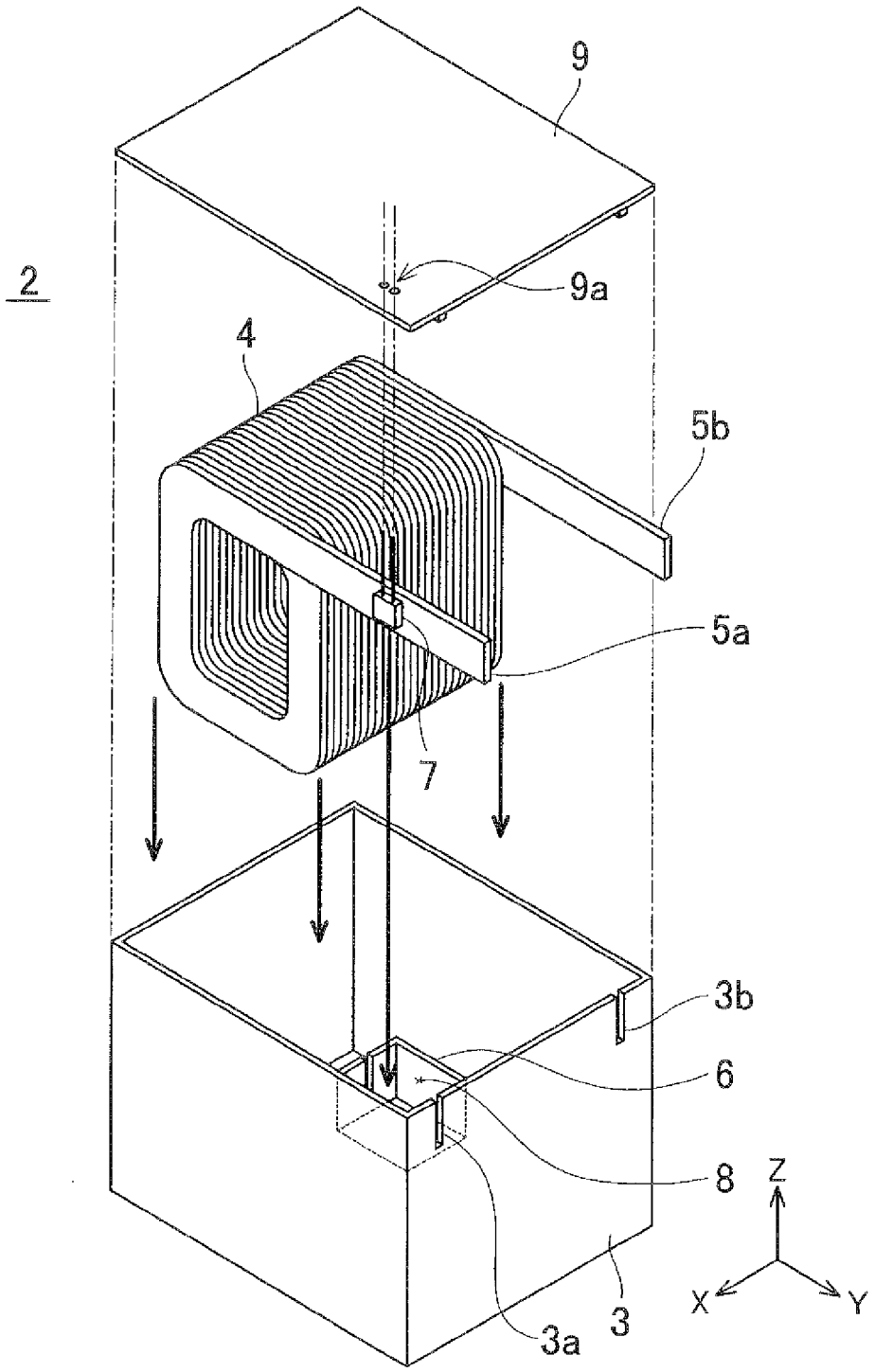
FIG. 2 is an exploded perspective view of the reactor according to an embodiment.

Description is hereinafter made of embodiments of the present invention with reference to the drawings. FIG. 1 shows a perspective view of a reactor according to an embodiment. In FIG. 1, the cover and the magnetic material-containing resin (resin containing a magnetic material) in the case of the reactor are not shown so that the structure in the case can be understood easily. FIG. 2 shows an exploded perspective view of the reactor.

As shown in FIG. 1, a reactor 2 has a coil 4 and a magnetosensitive element 7 that are housed, together with a magnetic shielding plate 6, in a case body 3. The coil 4 has lead wires 5*a* and 5*b* at both ends, and a magnetosensitive element 7 is attached to one of the lead wires (lead wire 5*a*). A magnetic shielding plate 6 is attached to the case body 3 to surround the magnetosensitive element 7. The magnetic shielding plate 6 shields the magnetosensitive element 7 from the magnetic field of the coil 4. The magnetic shielding plate 6 is formed integrally with the case body 3 by press working. As shown in FIG. 2, the magnetic shielding plate 6 and the case body 3 have slits 3*a* and 3*b* through which the lead wires 5*a* and 5*b* extend, respectively. As shown in FIG. 1, the gaps that are formed at the top of the slits 3*a* and 3*b* when the coil 4 is housed in the case body 3 are filled by protrusions that are formed on a lower surface of the cover 9. The case body 3 and the cover 9 form the case of the reactor 2. In other words, the case of the reactor 2 is formed of two parts, the case body 3 that houses the coil 4 and the cover 9 that closes the opening of the case body 3.

In the reactor 2 that is shown in FIGS. 1 and 2, a small space 8 that is defined by the magnetic shielding plate 6 is open at the top. When the cover 9 is placed over the entire opening of the case body 3, a part of the cover 9 covers the small space 8 from above and the small space 8 is closed. Thus, in this embodiment, a part of the cover 9 also serves as a magnetic shielding plate. The cover 9 has holes 9*a*. The holes 9*a* are formed to allow signal lines from the magnetosensitive element 7 to extend out of the case.

Figure 3:
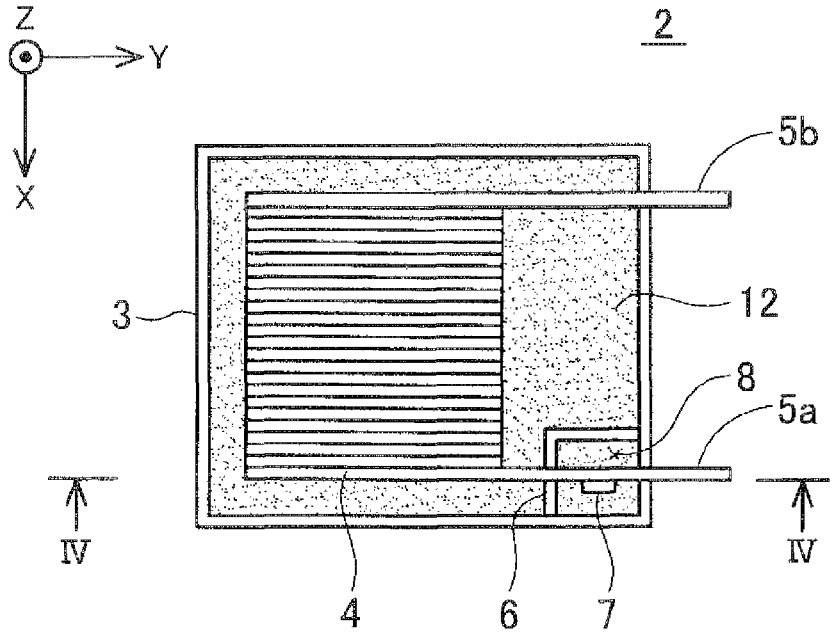
FIG. 3 is a plan view of the reactor according to an embodiment (with its cover removed)
Figure 4:
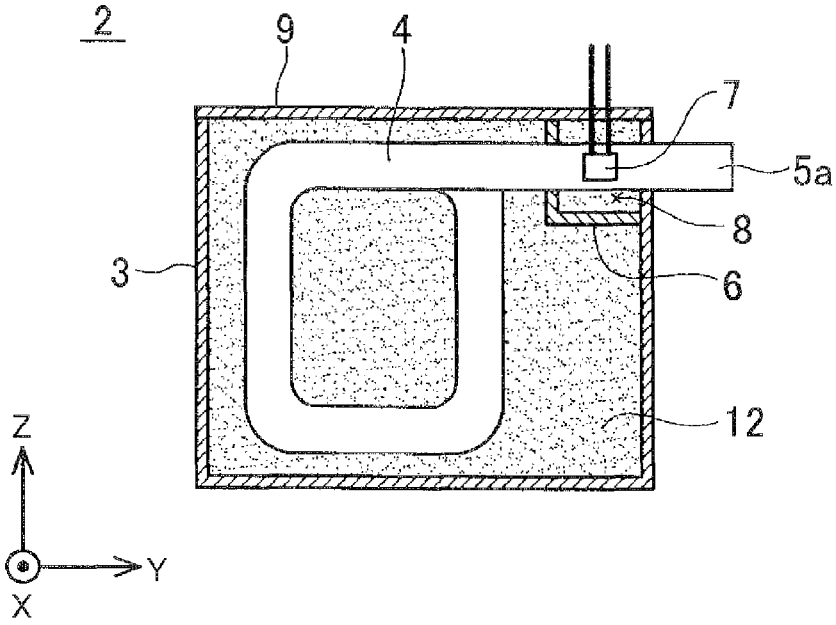
FIG. 4 is a cross-sectional view that is taken along the line IV-IV of FIG. 3.

The space in the case body 3, including the small space 8, is filled with a magnetic material-containing resin 12 (refer to FIGS. 3 and 4). The magnetic material-containing resin is not shown in FIG. 1 and FIG. 2 as described above. A magnetic material-containing resin is a mixture of a powder of a magnetic material, such as ferrite, and a powder of an insulating resin. The magnetic material-containing resin, which is originally powdery, is solidified by heating the entire case after it is filled in the case body 3. After that, the cover 9 is attached to the case body 3, whereby the space in the case is sealed.

FIG. 3 shows a plan view of the reactor 2 with the cover 9 removed, and FIG. 4 shows a cross-sectional view taken along the line IV-IV of FIG. 3 (the cover 9 is also shown in FIG. 4, though). As shown in FIG. 3 and FIG. 4, the magnetosensitive element 7 and the surrounding magnetic material-containing resin 12 are located in the small space 8, which is defined by the magnetic shielding plate 6, a part of the interior wall of the case body 3 and a part of the lower surface of the cover 9, and is completely isolated from the space in which the coil 4 is housed. An induction magnetic field that is induced by the current that flows through the lead wire 5*a* is generated around the lead wire 5*a* in the magnetic material-containing resin 12 in the small space 8. The magnetosensitive element 7 detects the induction magnetic field. A sensor controller (not shown) determines the magnitude of the current that flows through the lead wire 5*a*, in other words, the current that flows through the reactor 2, based on the magnitude of the induction magnetic field that is measured by the magnetosensitive element 7. In other words, a part of the magnetic material-containing resin 12 that fills the case body 3 constitutes a current sensor in conjunction with the magnetosensitive element 7 in the reactor 2. The magnetic material-containing resin 12 in the small space 8 functions as the core of the current sensor.

When a current flows, the coil 4 also generates an induction magnetic field. However, because the magnetosensitive element 7 and the surrounding magnetic material-containing resin 12 are shielded from the magnetic field of the coil 4 by the magnetic shielding plate 6 (including a part of the cover 9 and a part of the case body 3), the magnetic field of the coil 4 does not exert a significant effect on the magnetosensitive element 7. In other words, because the reactor 2 has the magnetic shielding plate 6, which shields the magnetosensitive element 7 and the surrounding magnetic material-containing resin 12 from the magnetic field of the coil 4, the possibility is low that induction magnetic field of the coil 4 exerts an effect on the current sensor that is constituted of the magnetosensitive element 7 and the surrounding magnetic material-containing resin 12. Thus, the magnetosensitive element 7 can measure the current that flows through the coil 4 precisely. The magnetic material-containing resin 12 that fills the space other than the small space 8 functions as cores in and around the coil 4.

In the reactor 2, the core of the coil 4 and the core of the current sensor are both made of the magnetic material-containing resin 12, and the cores are made by heating a magnetic material-containing resin that has been filled in the case body 3. The reactor 2 of this embodiment is highly manufacturable because the core of the coil 4 and the core of the current sensor does not have to be produced separately and assembled together but can be formed together. It should be noted that the magnetosensitive element 7 and the coil 4 do not necessarily have to be completely covered with the magnetic material-containing resin 12. A part of the coil 4 and/or a part of the magnetosensitive element 7 may be exposed.

The magnetic shielding plate 6, which is a member that blocks a magnetic field, is made of a metal. When a part of the case body 3 and/or the cover 9 are/is intended to function as a magnetic shielding plate, the case body 3 and/or the cover 9 are/is also made of a metal. The magnetic shielding plate 6, the case body 3, and the cover 9 are preferably made of aluminum. The magnetic shielding plate 6, the case body 3, and the cover 9 may be made of electromagnetic material. The magnetic shielding plate 6, which only has to be able to block a magnetic field, may not be a flat plate but may be a net-like member. When the magnetic shielding plate 6 is formed of a net-like member, the small space 8 can be easily filled with the unsolidified powder of the magnetic material-containing resin 12 when the case body 3 is filled with the unsolidified powder.

Figure 5:
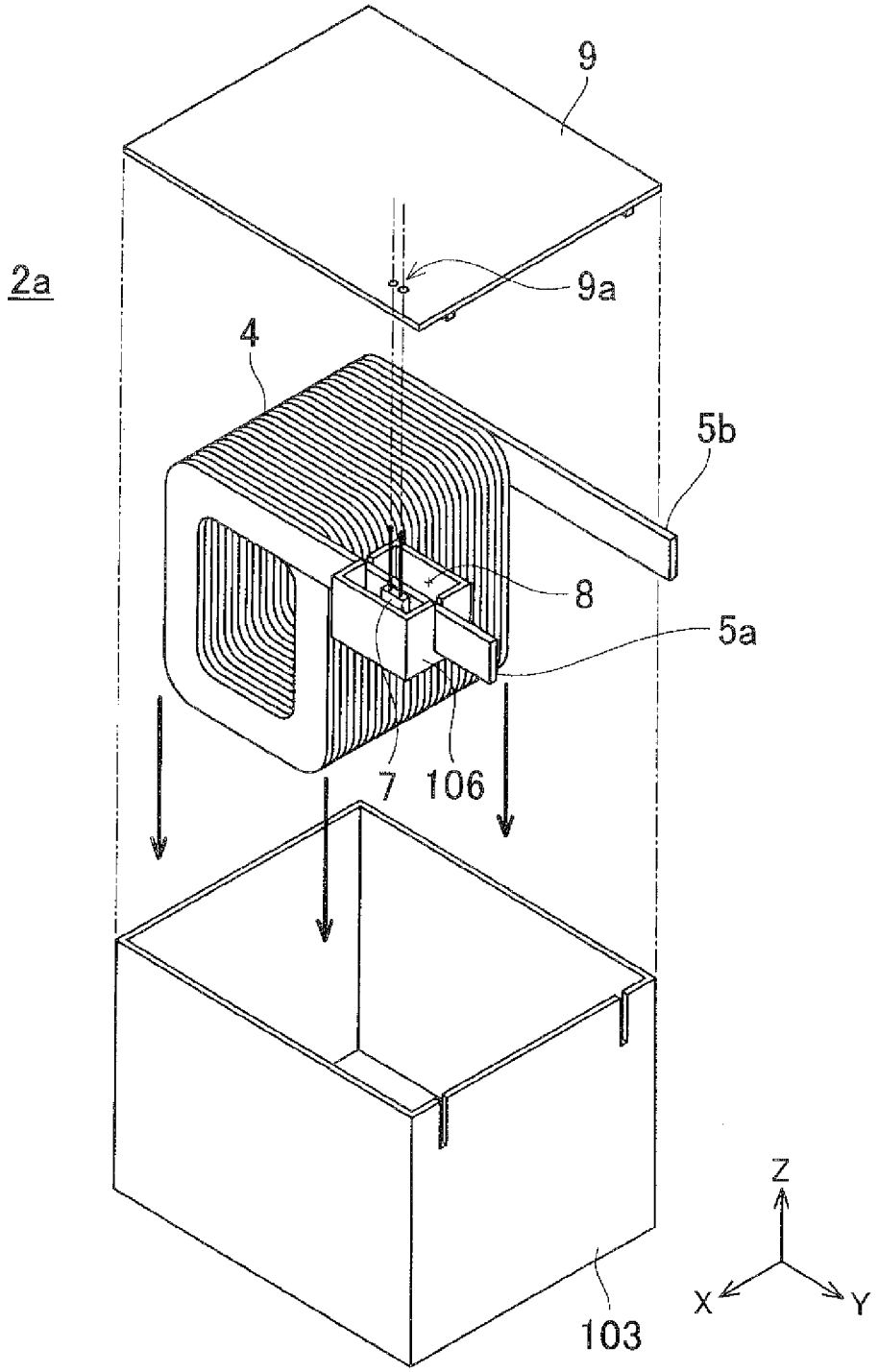
FIG. 5 is an exploded perspective view of the reactor according to another embodiment.

Another embodiment of the reactor 2 is described. The magnetic shielding plate 6 and the case body 3 of the reactor 2 in FIG. 1 to FIG. 4 may be integrally formed by press molding or injection molding. The magnetic shielding plate 6 is made of a metal to block a magnetic field. Also, a part of the case body 3 may function as a magnetic shielding plate 6, in which case the case body 3 is also made of a metal. The magnetic shielding plate 6 is made integrally with the case body 3 from an aluminum plate by press working, for example. The magnetic shielding plate 6 may be formed separately from the case body 3. FIG. 5 shows an exploded perspective view of a reactor 2*a* according to another embodiment. The reactor 2*a* has a magnetic shielding plate 106 which has the shape of a box with an open top. The box-shaped magnetic shielding plate 106 has a slit in each of two opposite walls, and a lead wire 5*a* of a coil 4 extends through the slits. A magnetosensitive element 7 is attached to the lead wire 5*a* in a small space 8 in the box-shaped magnetic shielding plate 106. The coil 4 is placed in a case body 103 together with the magnetic shielding plate 106 and the magnetosensitive element 7, and the space around the coil 4 and the small space 8 in the magnetic shielding plate 106 are filled with a magnetic material-containing resin. Then, the magnetic material-containing resin is solidified by heating. In other words, the core of the coil 4 and the core of the current sensor are formed. Finally, when a cover 9 is attached, the reactor 2*a*, in which the coil 4 and the magnetosensitive element 7 are embedded in a magnetic material (magnetic material-containing resin), is obtained.

Figure 6:
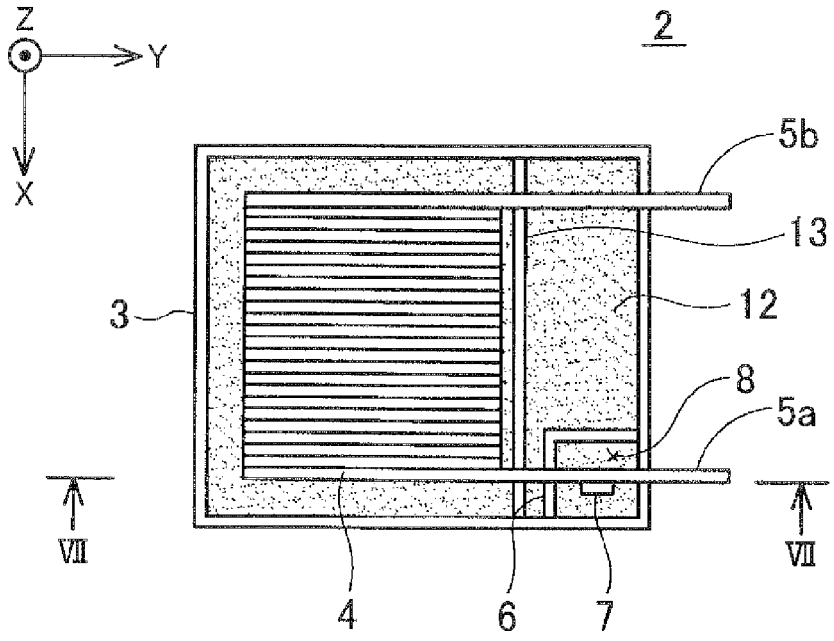
FIG. 6 is a plan view of the reactor according to another embodiment (with its cover removed)
Figure 7:
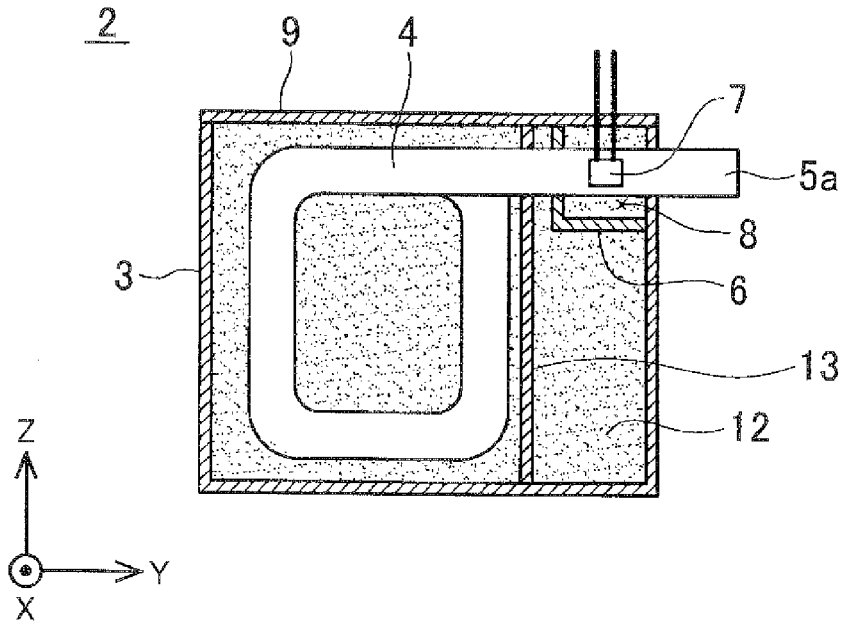
FIG. 7 is a cross-sectional view taken along the line VII-VII of FIG. 6.

In another embodiment, the reactor 2 may have, in addition to the above configuration, a partition plate 13 between the coil 4 and a magnetic shielding plate 6 as shown in FIG. 6 and FIG. 7. FIG. 6 is a plan view, and FIG. 7 is a cross-sectional view taken along the line VII-VII. The partition plate 13 may be formed integrally with the case body 3. When the partition plate 13 is made of a metal, the partition plate 13 has a function of blocking a magnetic field. Thus, the partition plate 13 can further reduce the effect of the magnetic field of the coil 4 on the current sensor that is constituted of the magnetosensitive element 7 and the surrounding magnetic material-containing resin 12. The space between the partition plate 13 and the magnetic shielding plate 6 may not be filled with the magnetic material-containing resin 12. When the space is not filled with the magnetic material-containing resin 12, a layer of air is formed between the partition plate 13 and the magnetic shielding plate 6. The formation of the layer of air can further reduce the effect of the magnetic field of the coil 4 on the current sensor. When the layer of air is formed, the partition plate 13 may be made of a material other than a metal.

Points to note about the embodiments are described. The magnetic material-containing resin may be obtained by shaping a mixture of a magnetic powder and a plastic resin by injection molding and solidifying the shaped mixture.

While specific examples of the present invention have been described in detail in the foregoing, these examples are merely for illustrative purpose and not intended to limit the scope of claims. The technique that is described in the claims includes various alterations and modifications of the specific examples that are illustrated above. The technical elements that are described in this specification or the drawings demonstrate technical utility when used singly or in various combinations, and the combinations of the technical elements are not limited to those described in the claims as filed. The technique that is illustrated in this specification or the drawings can simultaneously attain a plurality of objects, and attaining one of the purposes per se offers technical utility.

What is claimed is:

1. A reactor comprising:

a coil;

a core of the coil;

a magnetosensitive element attached to a lead wire of the coil;

a magnetic shielding plate that (i) is disposed between the core of the coil and the magnetosensitive element and (ii) shields the magnetosensitive element from a magnetic field of the coil, wherein the magnetic shielding plate is shaped as a box;

a case in which the magnetic shielding plate, the magnetosensitive element and the coil are housed, wherein the magnetic shielding plate is within the case; and a resin containing a magnetic material is filled in both (i) a first region of the case surrounded by the magnetic shielding plate and (ii) a second region of the case that includes the coil, wherein the resin containing the magnetic material filled in the first region of the case forms a core of the magnetosensitive element, wherein the magnetosensitive element and the coil are covered with the resin containing the magnetic material in the case.

2. The reactor according to claim 1, further comprising:

a partition plate provided between the magnetic shielding plate and the coil.

3. The reactor according to claim 1, wherein the magnetic shielding plate is formed integrally with the case.

4. The reactor according to claim 1, wherein the case is made from at least two parts, and a closed space is defined by the at least two parts combined.

* * * * *